United States Patent [19]

Treiber

[11] Patent Number: 4,615,757

[45] Date of Patent: Oct. 7, 1986

[54] METHOD AND APPARATUS FOR PACKAGE LABELING

[75] Inventor: Fritz F. Treiber, Centerville, Ohio

[73] Assignee: Hobart Corporation, Troy, Ohio

[21] Appl. No.: 751,176

[22] Filed: Jul. 3, 1985

[51] Int. Cl.[4] ..... B44B 9/00

[52] U.S. Cl. ..... 156/350; 156/360; 156/363; 156/384; 156/542; 156/566; 177/4

[58] Field of Search ..... 156/360, 350, 351, 355, 156/361–364, 566, 521, 522, 540–542, 384; 177/3, 4

[56] References Cited

U.S. PATENT DOCUMENTS

| | | | |
|---|---|---|---|
| 2,756,891 | 7/1956 | Hill | 156/522 X |
| 3,181,988 | 5/1965 | Engert | 156/350 |
| 4,415,048 | 11/1983 | Teraoka | 177/5 |
| 4,458,470 | 7/1984 | Fine | 53/502 |
| 4,561,921 | 12/1985 | Treiber | 156/542 X |

*Primary Examiner*—David Simmons

*Attorney, Agent, or Firm*—Biebel, French & Nauman

[57] ABSTRACT

Labels are positioned within selected labeling regions on packages processed by a packaging system or carried by a package conveyor by means of horizontally shifting a package labeler relative to packages to be labeled in response to package dimensions which define the edges of the packages. Label positioning is illustrated in an integrated packaging machine wherein packages are weighed, wrapped and labeled. Packages are weighed at an input tray of the machine and at least one horizontal package dimension is measured and represented by package signals as a package is transported to an elevator, which raises the package into a section of wrapping material which is then wrapped about the package as one or more labels are applied. A price labeler positioned over the elevator generates price labels for the packages in response to weight signals. A label applicator also positioned over the elevator receives and applies labels to the packages as they are being wrapped. The label applicator is shifted horizontally in response to the package signals to position labels on the packages within selected labeling regions. The label positioning method and apparatus of the present invention are generally applicable and may be used to apply any labels, for example, hi-lite information labels or price labels to packages.

26 Claims, 17 Drawing Figures

METHOD AND APPARATUS FOR PACKAGE LABELING

BACKGROUND OF THE INVENTION

This invention relates generally to packaging and package conveying systems and, more particularly, to a method and apparatus for package labeling wherein a labeler is moved horizontally relative to a package to be labeled to thereby more accurately position labels within selected labeling regions on packages processed and/or conveyed by the systems. This invention is particularly applicable to integrated packaging systems, including a wrapping machine, a weighing scale and a labeler, and hence, will be primarily described with reference to such integrated packaging machines.

A number of package wrapping machines are well known and used, for example, in supermarkets for packaging meats, produce and other food items. Such wrapping machines may provide at least two different widths of wrapping material to accommodate a large variety of package sizes. The wrapping material is provided in continuous rolls of different widths such that the length and width of sheets of wrapping material may be selected for wrapping packages. The length and width of a sheet of wrapping material to be used for a given package may be selected by the operator based on the package to be wrapped or may be automatically selected based on machine-sensed dimensions of the package.

Computing weighing scales and labelers which print and apply price labels to packages are oftentimes associated with wrapping machines. A computer or other electronic means is included within the scale or labeler for calculating prices for the packages. Prices are calculated by multiplying the net weight of a package times the price per unit weight of the commodity within the package, the unit price having been previously stored into a memory of the computer. Commodity net weight is determined by compensating for the tare weight or weight of the packaging material.

In the operation of a prior art packaging system, a commodity to be packaged is initially placed onto a supporting tray. The trayed commodity or package is then fed into the wrapping machine where a sheet of packaging material, typically transparent stretch film, is wrapped about the package and secured beneath the tray. The wrapped package is then conveyed either mechanically or manually to a combination scale and labeler. At the scale and labeler, the price of the package is computed, a price label is printed and the label is applied to the package.

In order to conserve space, packaging systems have combined a weighing scale, a wrapping machine and a label printer into a single unit. See, for example, Teraoka, U.S. Pat. No. 4,415,048, wherein a trayed commodity is initially placed onto a weighing scale which forms the input of a wrapping machine. The trayed commodity is weighed, wrapped and passed to a package outlet passage along which a labeler is positioned to generate a pricing label and apply the label to the wrapped package. In the Teraoka packaging system, labels are printed and applied downstream from the wrapping station along a wrapped package outlet passage such that labeling information must be stored and delayed or large gaps must be placed between consecutive packages for labels to correspond correctly to wrapped packages.

The heights of packages passing through the Teraoka packaging system are measured such that the label applying apparatus may be shifted vertically to accommodate varying heights of packages. Packages to be labeled are positioned beneath the package labeling apparatus by means of guide plates which position the packages laterally or both laterally and longitudinally. Package shifting for label positioning is also effected along a package outlet passage in an integrated packaging machine disclosed in Fine, U.S. Pat. No. 4,458,470.

To overcome the problems created by having to store and delay the weight signals of packages or the packages themselves progressing through a packaging machine, an improved packaging system is disclosed in Boshinski, U.S. Pat. No. 4,543,766 which is incorporated herein by reference. In the Boshinski packaging system, the wrapping machine is an elevator-type machine presently quite popular in the supermarket industry. A labeler is positioned over the elevator and a weighing conveyor extends between a package feed-in tray and the elevator such that a package is weighed as it is conveyed to the elevator, a label is printed and applied to the package as the package is wrapped by elevation into a sheet of wrapping material.

While the Boshinski packaging system eliminates the necessity of large gaps between consecutive packages or delaying the scaled weights of packages within the machine and also the need for vertically shifting the labeler to accommodate varying heights of packages, it is impossible to provide the package positioning guide rails or other package shifting apparatus for selectively positioning labels upon packages processed by the system. This shortcoming may be very important to a supermarket since it is oftentimes desirable to be able to position a pricing label in a specified portion of the package, typically near a corner, such that packages may be attractively displayed and permit the consumer to readily read the price of individual packages from a normal viewing position. Hence, the need exists for label positioning on packages where it is impossible or undesirable to shift the package itself, for example, within integrated packaging systems such as the Boshinski system disclosed in above-referenced U.S. Pat. No. 4,543,766.

SUMMARY OF THE INVENTION

It is a primary object of the present invention to provide a method and apparatus for positioning labels within a selected labeling region on packages processed by a packaging system or conveyed by a package conveyor wherein labeling apparatus is horizontally shifted relative to packages to be labeled in response to package dimensions which identify or define the edges of the packages. The label positioning of the present invention facilitates handling, display and sale of the packages and is equally applicable to price labels and "hi-lite" information labels. "Hi-lite," as used herein, will identify labels which are used to provide additional information to a consumer regarding the contents of a package. Typical examples include "catch of the day" for fish, "price reduced," "best for barbeque," and the like.

In accordance with one aspect of the present invention, package labeling apparatus is associated with a package handling system including at least a package conveyor for transporting packages. The package labeling apparatus includes package labeler means which are mounted above the package conveyor for labeling packages supported on the conveyor. Package sensing means are included for sensing at least one horizontal dimension of the packages as they are transported on the conveyor, and for generating package signals representative of the at least one sensed horizontal dimension of the packages. Label positioning means are connected to the package labeler means and the package sensing means for horizontally moving the package labeler means in response to the package signals such that labels are positioned on the packages within selected labeling regions for convenient handling, display and sale of the packages.

The package labeler means may comprise label printer means for generating the labels to be applied to the packages. If price labels are to be applied to the packages, the package labeling apparatus further comprises weighing means positioned along the conveyor for generating weight signals representative of weights determined for the packages. The printer means is then responsive to the weight signals to print the price labels. Alternatively, or in addition to price labels, hi-lite labels may be printed and applied to the packages to provide information about the contents of the packages.

A method for package labeling utilizing the recited apparatus comprises the steps of: conveying a package to be labeled to a labeling station; supporting a package labeler for horizontal movement to define said labeling station; generating package signals identifying at least two opposite sides of the package; horizontally moving the package labeler in response to the package signals to select a labeling position corresponding to the package signals; and, applying a label to the selected labeling position of the package at the labeling station.

Preferably, the step of generating the package signals comprises sensing the package as it is conveyed to the labeling station. In the interest of reducing inventory of label stock and simplification of label feeding, the method also preferably includes the step of generating the label for the package labeler. If a price label is to be applied, the further step of determining the weight of the package is necessary and the step of generating the label comprises printing the price determined from the weight on the label. In place of price labels or in addition to price labels, the step of generating the label may comprise printing a hi-lite label to inform consumers about characteristics of the contents of the package.

In accordance with another aspect of the present invention, label positioning apparatus is included in a packaging system or machine wherein packages to be weighed, wrapped and labeled are conveyed from a package input station to a package wrapping and labeling station where the packages are raised by an elevator into sections of wrapping material which are then wrapped about the packages as labels are applied thereto. Transportation means convey packages from the package input station to the package wrapping and labeling station, and weighing means are positioned along the transportation means for generating weight signals in response to the packages. Control means generate package signals representative of at least one horizontal dimension of the packages. Label printing means connected to the weighing means is responsive to the weight signals for printing labels for the packages and delivering the labels to a label delivery station. Label applicator means are positioned over the elevator for receiving labels from the label delivery station and applying the labels to the packages as they are being wrapped. Label positioning means are connected to both the label applicator means and the control means for shifting the position of the label applicator means horizontally in response to the package signals. The labels are thereby positioned on the packages within selected labeling regions for convenient handling, display and sale of the resulting wrapped and labeled packages.

The weighing means may comprise a scale positioned within the package input station and the transportation means may comprise at least one package pusher which is selectively operable between a package engaging position for pushing packages into the packaging machine and a package non-engaging position for retracting the package pusher beneath the package input station with the package pusher being operated in response to weight signals indicating that stabilized weights have been determined for the packages. Preferably, the label printing means is pivotally mounted such that it can be pivoted between an automatic labeling position wherein labels are dispensed over the wrapping and labeling station and a manual labeling position wherein labels are dispensed substantially over the package input station.

The control means may comprise data storage means programmed for generating at least one horizontal dimension of packages entering the packaging machine in response to operator input control signals. Preferably, sensing means within the machine determine at least one horizontal dimension of the packages as the packages are conveyed from the package input station to the package wrapping and labeling station.

A method for package labeling utilizing the previously recited apparatus comprises the steps of: weighing a package to generate weight signals representative of the package; conveying the package from a package input station to a package wrapping and labeling station; generating package signals representative of at least one horizontal dimension of the package; printing a label in response to the weight signals; horizontally moving label applying means positioned vertically over said package wrapping and labeling station in response to the package signals to select a labeling position corresponding to the package signals; and, applying the label to the package as the package is being wrapped in a section of wrapping material.

The weight signals may be generated such that they indicate a stable weight has been determined for the package and a portion of the step of conveying the package to the package wrapping and labeling station may be performed by a package pusher which is selectively operable between a package engaging position for pushing packages into the packaging machine and a package non-engaging position for retracting the package pusher beneath the package input station. In that case, the step of conveying the package to the package wrapping and labeling station comprises operating the package pusher in response to the weight signals.

The step of generating package signals may comprise reading the package signals from data storage means where they have been previously stored or preferably sensing the at least one horizontal dimension of the package as it is conveyed from the package input station to the package wrapping and labeling station. The method may further comprise pivotally mounting a label printer which performs the step of printing a label whereby the label printer can be pivoted between an automatic labeling position wherein labels are fed over the package wrapping and labeling station and a manual labeling position wherein labels are fed substantially over the package input station.

In accordance with yet another aspect of the present invention, a method for package labeling may be applied to a wrapping machine wherein packages to be weighed, wrapped and labeled are conveyed from a package input station to a package wrapping and labeling station where the packages are elevated into sections of wrapping material which are then wrapped about the packages as labels are applied thereto, with the packages being divided into at least two package size groups which are identified either by sensing the packages within the packaging machine or by the machine operator. The method comprises: weighing the packages to generate weight signals representative of the packages; conveying the packages to the package wrapping and labeling station; generating package size group signals representative of the packages; printing labels in response to the weight signals; horizontally moving label applying means positioned over the package wrapping and labeling station in response to the package size group signals to select a labeling position corresponding to the package size group signals; and, applying the labels to the packages as the packages are being wrapped in the sections of wrapping material.

As previously noted, the present invention is equally applicable to pricing label application and/or hi-lite information label application. Hi-lite labels are used to provide additional information to a consumer by amplifying characteristics of the product. For example, hamburger may be designated as "fresh ground," pork chops as "thin cut," a certain beef roast indicated as the "special of the day," and so forth. Typically, such labels are purchased preprinted and are in fluorescent or bright colors to attract attention and are hand-applied to packages wrapped or wrapped and price labeled prior to application of the hi-lite labels.

In accordance with this aspect of the present invention, a package labeling arrangement is disclosed for a packaging machine wherein packages to be wrapped and labeled are conveyed from a package input station to a package wrapping and labeling station where the packages are elevated into sections of wrapping material which are then wrapped about the packages as labels are applied thereto. Transportation means are provided for conveying packages from the package input station to the package wrapping and labeling station and control means generate package signals representative of at least one horizontal dimension of the package. Hi-lite label feeder means, preferably including a printer for printing designated hi-lite labels in response to hi-lite label information data, deliver hi-lite labels to a hi-lite label applicator means positioned over the wrapping and labeling station for applying the hi-lite labels to the packages as they are being wrapped. Hi-lite label positioning means are connected to the hi-lite label applicator means and the control means for shifting the position of the hi-lite label applicator means horizontally in response to the package signals such that the hi-lite labels are positioned on the packages within selected hi-lite labeling regions to facilitate handling, display and sale of the packages.

Of course, both price and hi-lite labels can be applied in accordance with the present invention. In that case, the apparatus immediately recited above further comprises weighing means positioned along the transportation means for generating weight signals in response to the packages; price label printing means connected to the weighing means and responsive to the weight signals for printing price labels for the packages; and, price label applicator means positioned over the wrapping and labeling station for receiving price labels and applying them to packages as the packages are being wrapped, with the label positioning means being further connected to the price label applicator means for shifting the position of the price label applicator means horizontally in response to package signals such that price labels are also applied and positioned on the packages within selected price labeling regions.

A method for package labeling utilizing the above-identified apparatus comprises the steps of: conveying a package from a package input station to a package wrapping and labeling station; generating package signals representative of at least one horizontal dimension of the package; delivering a hi-lite label to hi-lite label applying means positioned over the package wrapping and labeling station; horizontally moving the hi-lite label applying means in response to the package signals to select a hi-lite labeling position corresponding to the package signals; and, applying the hi-lite label to the package as the package is being wrapped in a section of wrapping material. Preferably, the step of delivering a hi-lite label comprises printing the hi-lite label to reflect hi-lite label information corresponding to a package being processed by the packaging machine.

Both pricing and hi-lite labeling may be performed in the method further comprising the steps of: weighing the package to generate weight signals representative of the package; printing a price label in response to the weight signals; delivering a price label to a price label applying means positioned over the package wrapping and labeling station; horizontally moving the price label applying means in response to the package signals to select a price labeling position corresponding to the package signals; and, applying the price label to the package as the package is being wrapped in the section of wrapping material.

Other objects and advantages of the invention will be apparent from the following description, the accompanying drawings and the appended claims.

DETAILED DESCRIPTION OF THE INVENTION

Overall operation of a package elevating wrapping machine is fully described in Treiber et al., U.S. Pat. No. 4,501,106 which is incorporated herein by reference. Further, the operation of such a wrapping machine wherein a labeler is positioned over an elevator and a weighing conveyor extends between a package input station and the elevator such that the package is weighed as it is conveyed to the elevator and a label is printed and applied to the package as the package is wrapped by elevation into a sheet of wrapping material is disclosed in the above-referenced Boshinski U.S. Pat. No. 4,543,766. Accordingly, the description of the operation of such a wrapping machine will be limited to that necessary for describing the label positioning of the invention of the present application. For a more detailed description of wrapping and packaging machines, the referenced patent and patent application should be consulted.

It is noted that the present invention is broadly directed to a method and apparatus for positioning labels within a selected labeling region on packages processed by a packaging system or transported by a package conveyor. Label positioning is performed by horizontally shifting a package labeler relative to packages to be labeled, with the shifting being performed in response to package dimensions which define the edges of the packages. Accordingly, the invention is not limited to any particular packaging machine design and, in fact, can even be applied to hand wrapping of packages provided the wrapped packages are transported or carried along a package conveyor. Nevertheless, the invention is particularly applicable to integrated packaging systems, such as the system of the referenced Boshinski patent which include a wrapping machine, a weighing scale and a labeler and hence, the invention will be described with reference to such a system.

Figure 1:
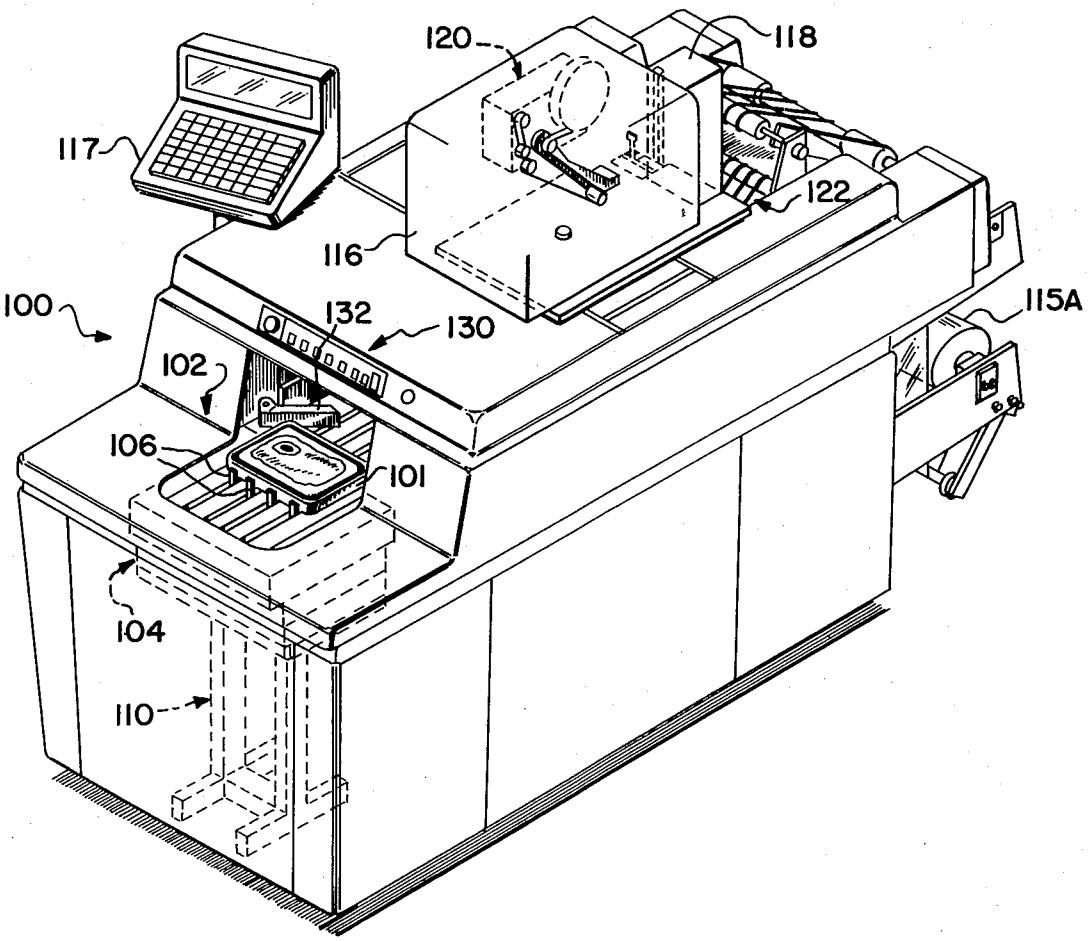
FIG. 1 is a perspective view of a packaging machine including the invention of the present application.
Figure 3:
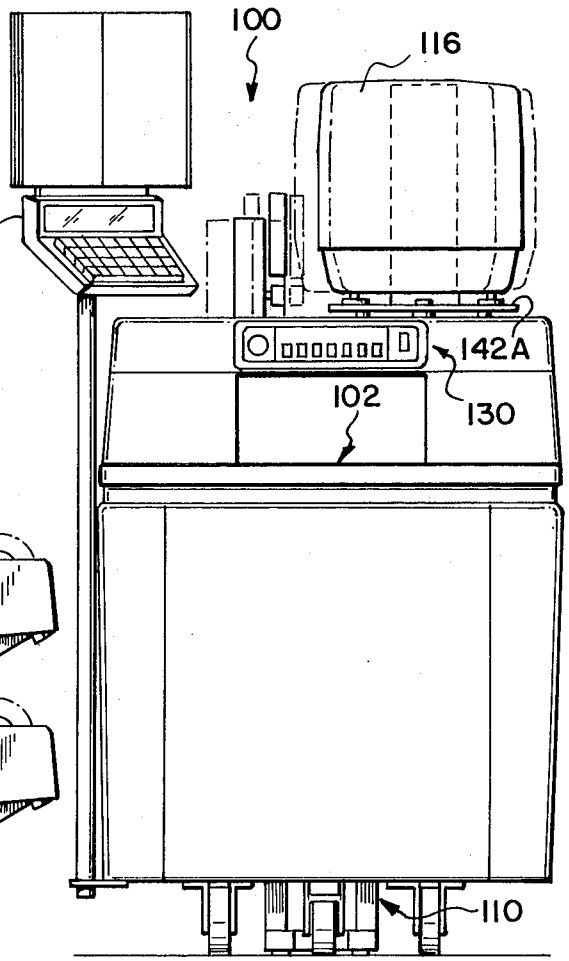
FIGS. 2–4 are a side view, an operator's end view and a top view, respectively, of the packaging machine of FIG. 1.

FIG. 1 is a perspective view of a packaging machine 100 incorporating the invention of the present application. As an overview, the general operation of the packaging machine 100 will be described for weighing, wrapping and labeling a package 101. Although a number of packages are shown throughout the drawings, and these packages may vary in size, they will be generically indicated by the numeral 101. The package 101 typically comprises meat or other food products placed upon a tray, i.e., a trayed commodity, which is to be wrapped in stretchable film for attractive display. In addition, the trayed commodity is to be weighed and appropriately price labeled and/or labeled with a hi-lite label which provides additional information to a consumer by identifying or "hi-liting" characteristics of the product. For example, hamburger may be designated as "fresh ground," pork chops as "thin cut" or "thick cut," a certain roast beef as the "special of the day," and so forth.

Figure 2:
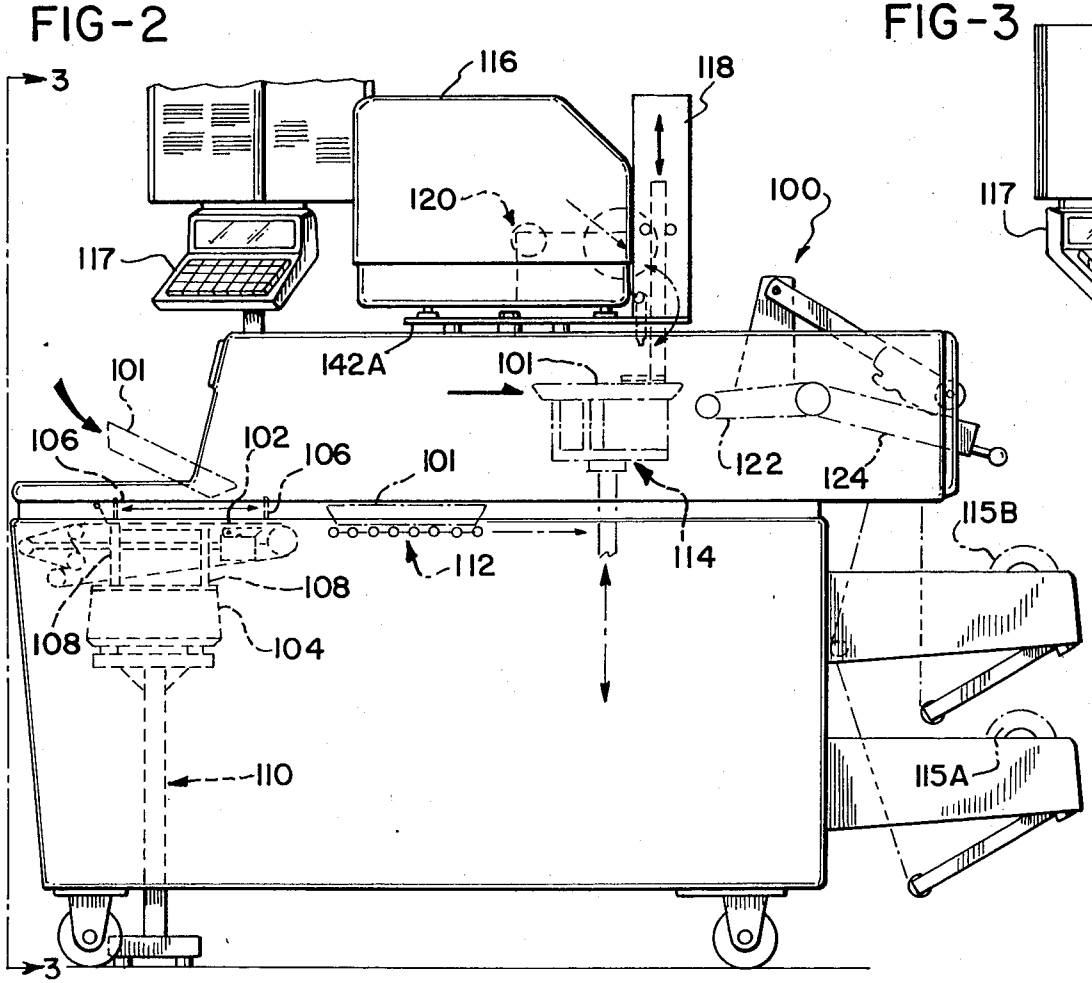
Figure 4:
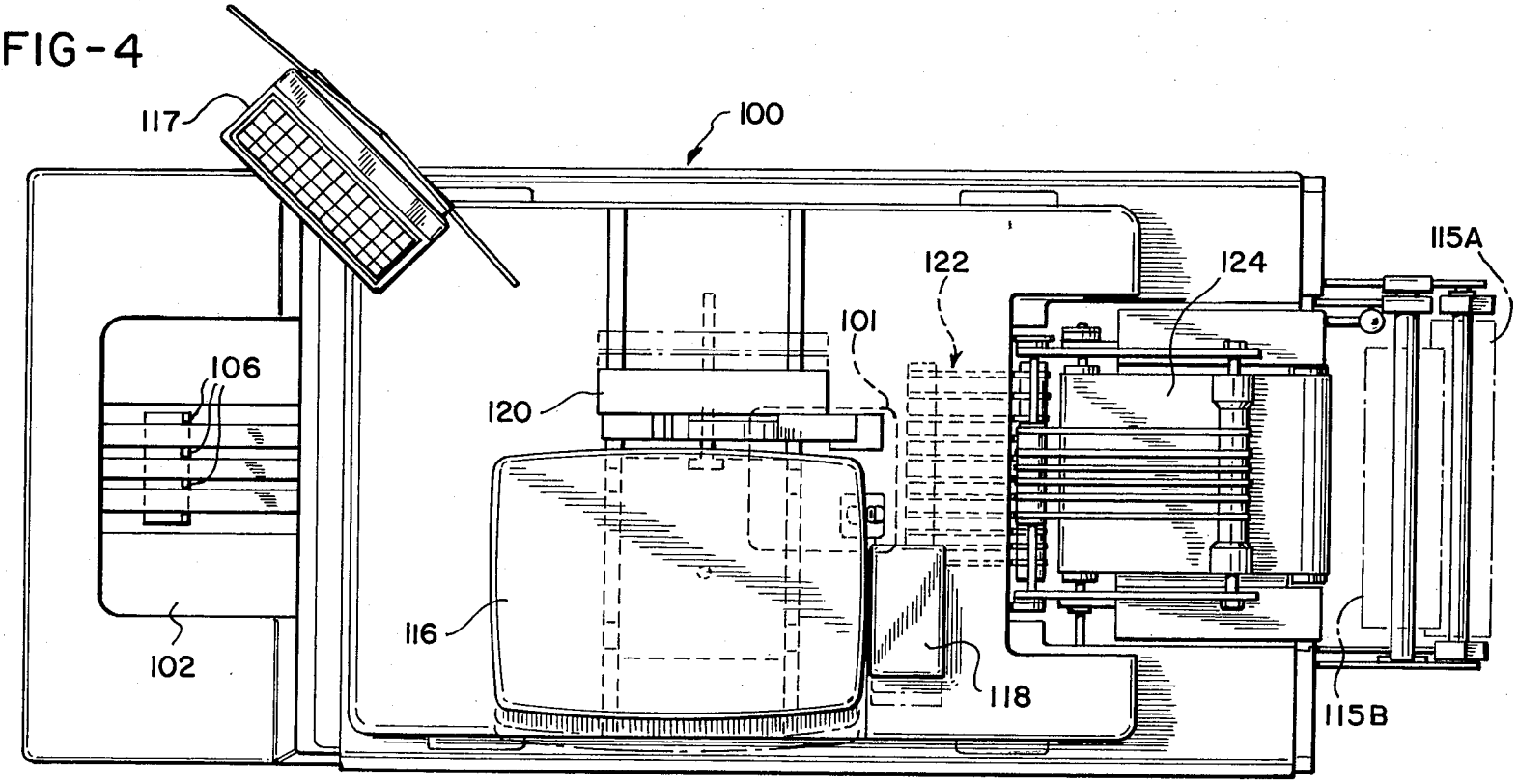
Figure 15:
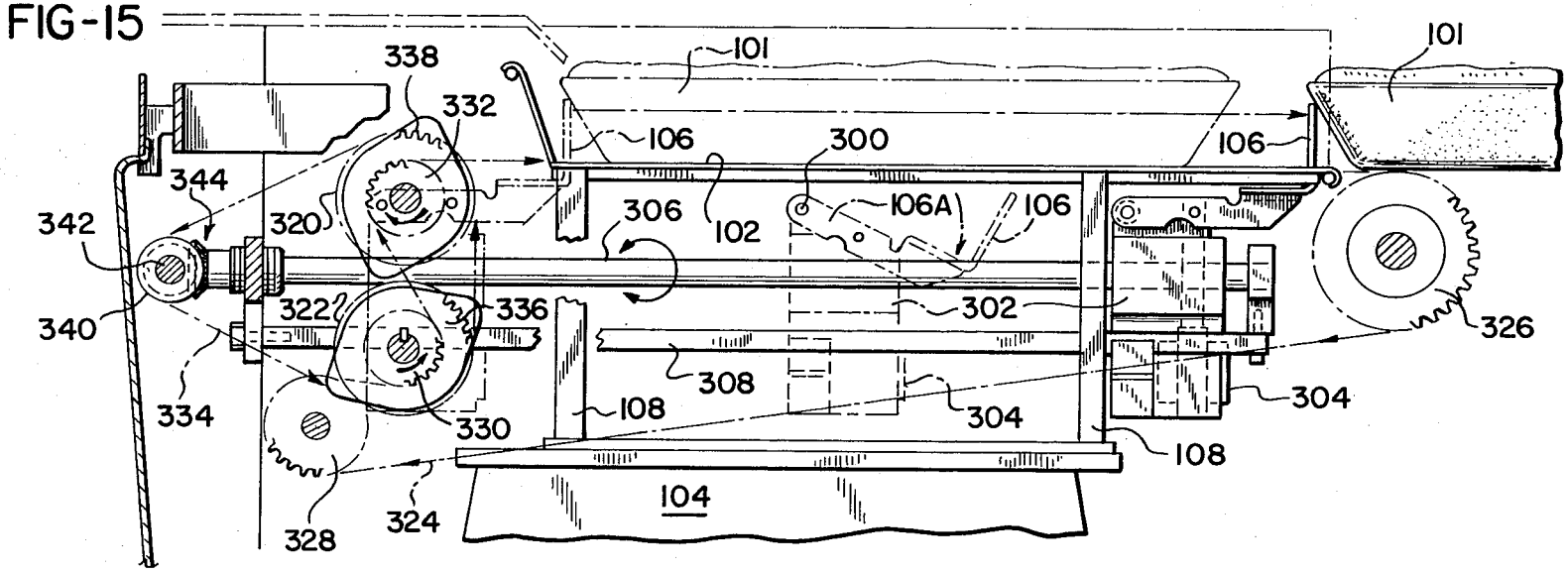
FIGS. 15 and 16 show an illustrative embodiment of a package pusher for use in the present invention.

In any event, the package 101 is placed into a package input station generally defined by an input tray 102. In the illustrated embodiment, the input tray 102 forms a weighing platter for a scale 104. The input tray 102 is slotted to receive a package pusher 106 which is operable for advancing the package 101 into the packaging machine 100. As best shown in FIGS. 1, 2 and 15, the input tray 102 is supported by vertical members 108 to form the weighing platter for the scale 104. The scale 104 and, in turn, the input tray 102 forming the scale platter are supported by a stand 110 directly from the floor and independent of the remainder of the packaging machine 100 such that vibrations within the packaging machine 100 do not effect weights determined by the scale 104 or the stability of the scale 104.

As best shown in FIG. 2, the package 101 is initially placed into the input station, i.e., onto the input tray 102, where it is weighed by the scale 104. Upon obtaining a stable weight for the package 101, the package pusher 106 is activated to push the package 101 further into the packaging machine 100. The package pusher 106 will be more fully described hereinafter with reference to FIGS. 15 and 16 and is operated in synchronism with package conveyors 112 to convey the package 101 to an elevator 114 which in turn elevates the package 101 into a section of stretched film drawn from a selected one of two continuous sources of film 115A and 115B. The film section is then wrapped about the package 101 in accordance with the referenced patents.

Once weight signals are stably determined by the scale 104, those stable weight signals are passed to a price labeler 116 which calculates a price for the package 101 and generates a price label. The price for the package 101 is determined in a well known manner by applying a unit price for the trayed commodity to the net weight for the trayed commodity. Both the unit price and commodity identification were previously entered by an operator via a keyboard 117, and the net weight is determined from the gross weight designated by the stable weight signals by subtracting a tare weight, i.e., the weight of the package material, for the package 101. The price label generated by the price labeler 116 is passed to a label applicator 118 which in turn applies the price label to the package 101 as it is being wrapped in a stretched film sheet.

Alternately, or at the same time, a hi-lite labeler 120 may be applying a hi-lite label to the package 101. The hi-lite label may be either preprinted or it may be printed by the hi-lite labeler 120 as will become apparent. The package 101 thus weighed, wrapped and labeled with a price label and/or a hi-lite label is ejected onto a package conveyor 122 which carries the package 101 to a sealing conveyor 124 to complete the wrapping operation and to pass the completed package 101 from the packaging machine 100.

In accordance with the present invention, the price label applicator 118 and/or the hi-lite labeler 120 are moved horizontally in response to package signals representative of at least one horizontal dimension of packages being processed by the packaging machine 100. In the embodiment illustrated, the horizontal shifting of the price label applicator 118 and the hi-lite labeler 120 is limited to lateral shifting, i.e., back and forth across the machine; however, it is apparent that longitudinal shifting of the label applicators is also possible and such longitudinal shifting is contemplated in accordance with the present invention.

In the illustrated embodiment of the invention, the width dimension, i.e., the lateral dimension of the package as it enters the machine, must be determined such that it can be utilized to control the lateral positioning of the price label applicator 118 and the hi-lite labeler 120. The lateral or width dimension W of packages being fed into the packaging machine 100 can be defined by the operator either via the keyboard 117 or the input controls 130 of the wrapping portion of the machine in accordance with referenced U.S. Pat. No. 4,501,106. Alternately, the lateral or width dimensions W of packages being fed into the packaging machine 100 are determined by package sensing means 132, see FIG. 1 and referenced U.S. Pat. No. 4,501,106 which sense or measure the width dimensions of packages as they are passed from the input tray 102 to the elevator 114. In either event, the lateral positioning of the price label applicator 118 and the hi-lite labeler 120 are selected in response to the width dimensions of packages being processed which define the edges of the packages.

Figure 6:
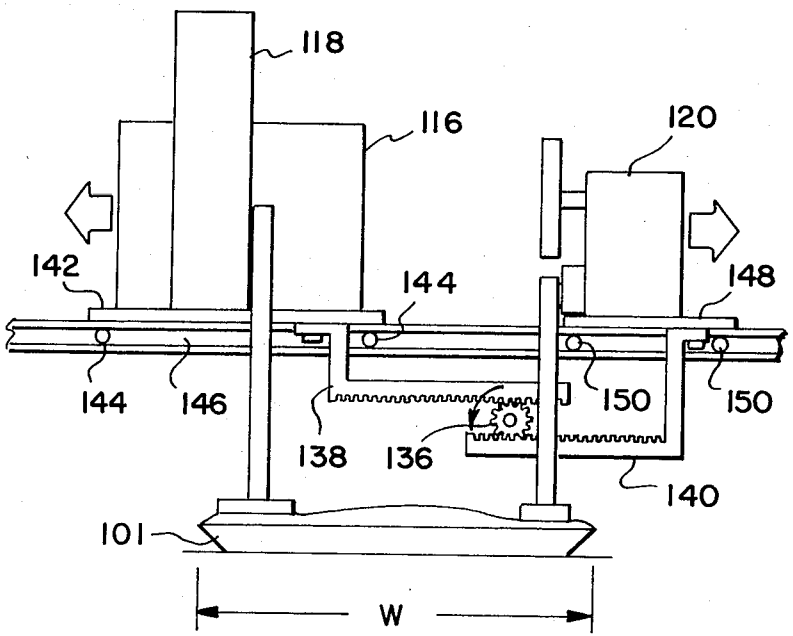
FIGS. 5 and 6 schematically illustrate the shifting of labeling apparatus in accordance with the present invention.
Figure 7:
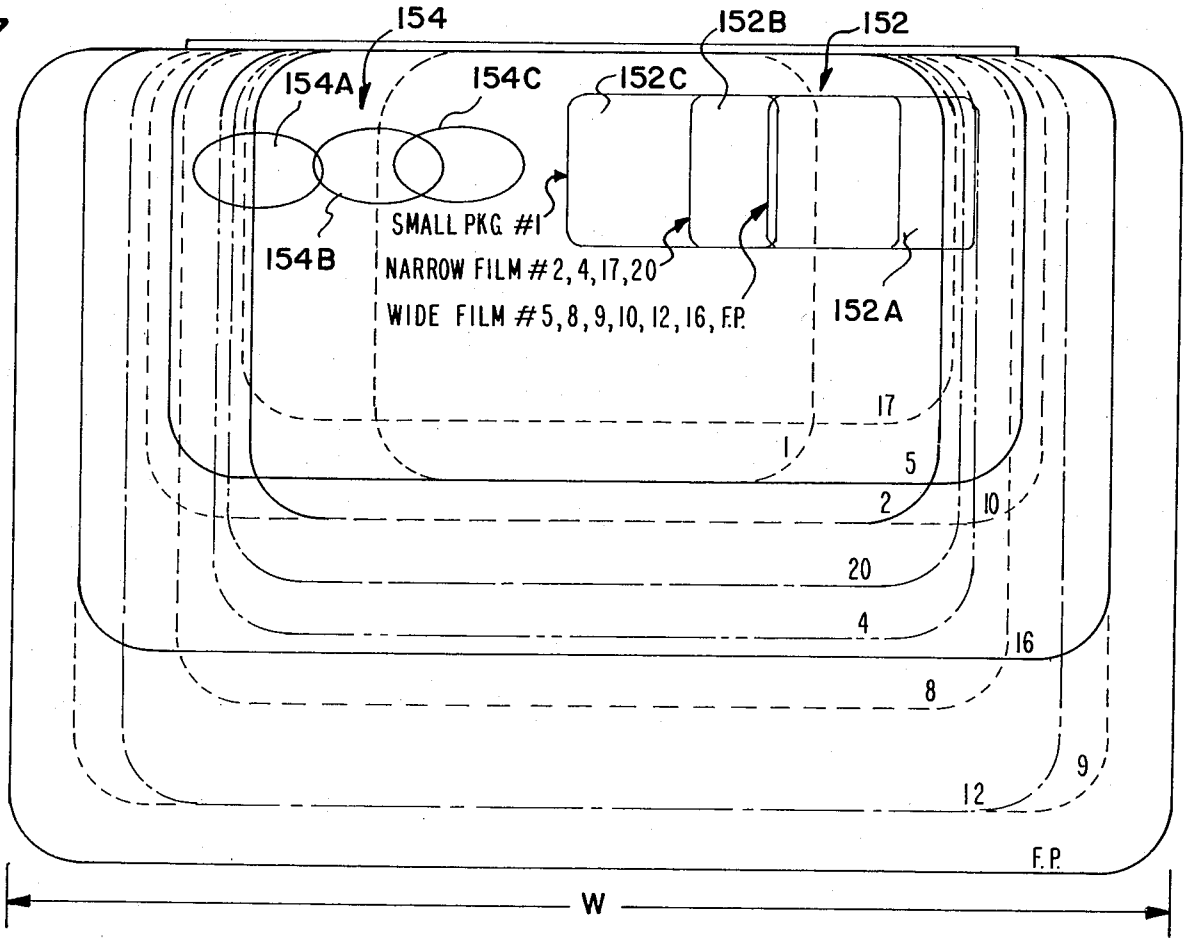
FIG. 7 illustrates the variety of package sizes which may be weighed, wrapped and labeled in the packaging system of the present invention together with the associated labeling positions for applying pricing and/or hi-lite labels to those packages.

The horizontal movement of the price label applicator 118 and the hi-lite labeler 120 in accordance with the illustrated embodiment of the present invention is best shown in FIGS. 3–6 with the resulting label positioning on wrapped packages being shown in FIG. 7. It is noted that in the illustrated embodiment, the price labeler 116 is moved together with the label applicator 118; however, this is not necessary in accordance with the present invention since only the position of the price label applicator 118, i.e., price label application, needs to be selected as will be apparent.

Figure 5:
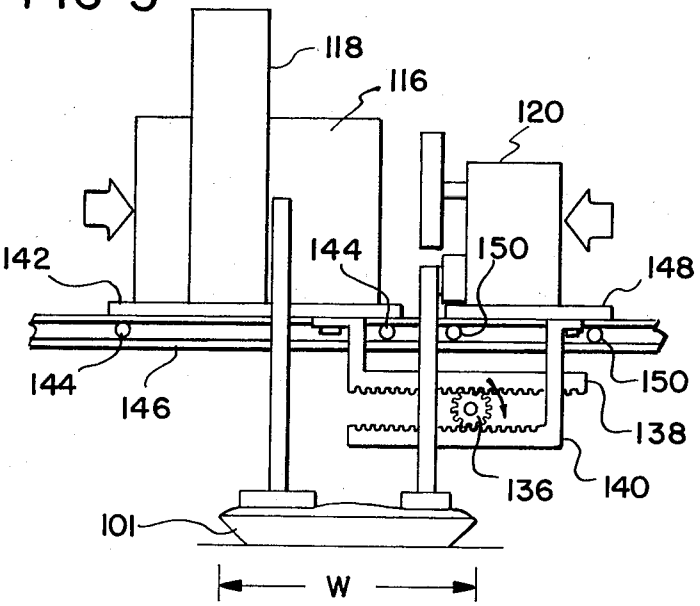
Figure 8:
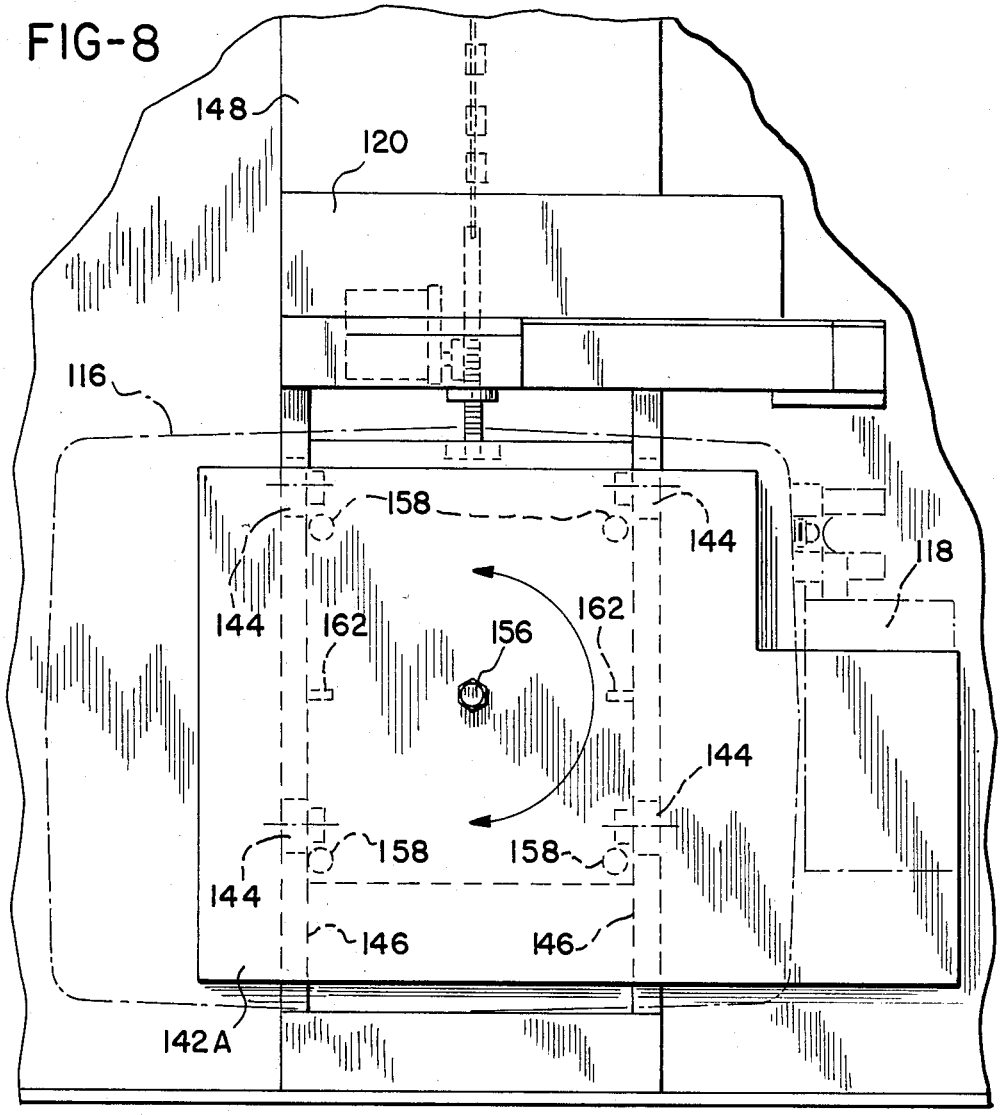
FIGS. 8–10 show the top, side and front views, respectively, for a pivotal mounting plate for supporting the price labeling apparatus of the packaging machine of FIG. 1.
Figure 9:
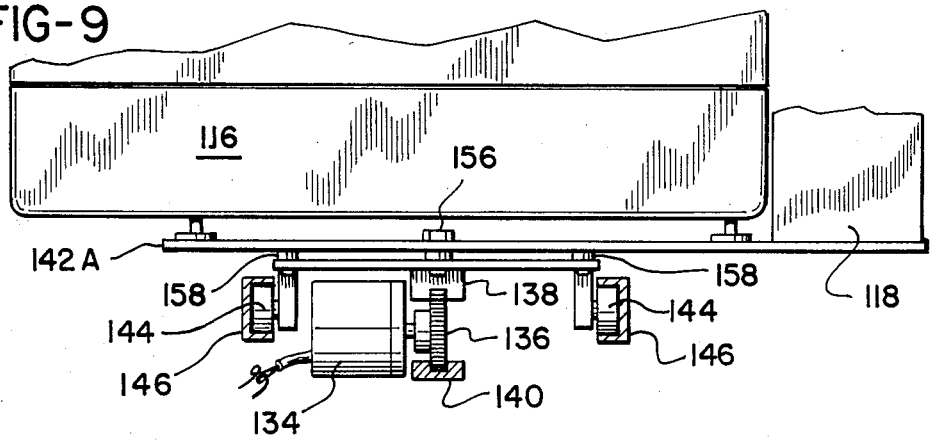

As shown schematically in FIGS. 5 and 6, the lateral positioning of the price label applicator 118 and the hi-lite labeler 120 are controlled by means of a rack and pinion arrangement. A motor 134 shown in FIGS. 8, 9 and 17 controls the rotation of a pinion gear 136 which in turn drives an upper rack 138 associated with the price label applicator 118 and a lower rack 140 associated with the hi-lite labeler 120. As best seen in FIGS. 5 and 6, when the pinion gear 136 is rotated clockwise by the motor 134, the price label applicator 118 and the hi-lite labeler 120 are moved toward one another; and when the pinion gear 136 is rotated counter-clockwise, the price label applicator 118 and the hi-lite labeler 120 are moved away from one another.

The upper rack 138 is connected to a price labeler support plate 142 which is mounted for lateral movement by means of rollers 144 which are engaged in a pair of tracks 146. The lower rack 140 is connected to a hi-lite labeler support plate 148 which is mounted for lateral movement by means of rollers 150 which are also supported within the tracks 146. Thus, by controlling operation of the drive motor 134 in response to package signals representative of at least one horizontal dimension of packages entering the processing machine 100, in the illustrated embodiment the width dimension W, the pricing labels 152 are positioned within a selected price labeling region and the hi-lite labels 154 are positioned within a selected hi-lite labeling region.

While it is apparent that the exact positioning of the pricing labels 152 and/or the hi-lite labelers 154 may be continuously varied within the range limitations shown in FIG. 7 in correspondence with the width dimension of a package either provided by an operator or by package sensing means, it is convenient to provide a selected number of labeling locations corresponding to at least two package size groups which can be identified by the packaging machine 100.

In this regard and as shown in FIG. 7, three package size groups are identified. The three package size groups correspond to the tray sizes shown in FIG. 7 and are more fully described in the referenced U.S. Pat. No. 4,501,106. Generally, the three size groups correspond to: packages to be wrapped in wide film with price labels located at the position 152A and hi-lite labels located at the position 154A; packages to be wrapped in narrow film with price labels located at price label position 152B and hi-lite labels located at hi-lite label position 154B; and packages defined as "small packages" with price labels located at price label position 152C and hi-lite labels located at hi-lite label position 154C. The positioning of the price label applicator 118 and/or the hi-lite labeler 120 into a selected labeling location may be controlled by monitoring the angular orientation of a drive shaft of the motor 134 or by positioning proximity sensors (not shown) which may monitor the positions of the upper rack 138 and/or the lower rack 140 as will be apparent to those skilled in the art.

While the labelers and labeler shifting mechanism shown schematically in FIGS. 5 and 6 are mounted above the elevator 114 of the packaging machine 100 in the illustrated embodiment, it is apparent that this same apparatus may be mounted to a package conveyor for more general application of the present invention. In that event, the packages 101 as shown in FIGS. 5 and 6 would be supported upon a package conveyor, and the package dimensions which define the edges of the packages would be sensed or input by the operator to control the horizontal shifting of the labelers. Packages may be stopped on the conveyor for labeling or may be labeled on the move depending upon the package labeler used and the requirements of each application.

Although the price labeler 116 and the label applicator 118 are shown as being directly supported upon the support plate 142 in FIGS. 5 and 6, preferably, as shown in the illustrated embodiment, the price labeler 116 and the label applicator 118 are supported upon a movable plate 142A which is pivotally mounted to the plate 142 by means of a centralized bolt 156 about which the plate 142A may be pivoted. Stabilizing pads 158 may be secured to the support plate 142 to help stabilize and support the movable plate 142A. The movable plate 142A may be pivoted between an automatic labeling position wherein the outlet of the package labeler 116 and the label applicator 118 are positioned over the wrapping and labeling station, generally defined by the elevator 114, and a manual labeling position substantially over the package input station, generally defined by the input tray 102.

Figure 10:
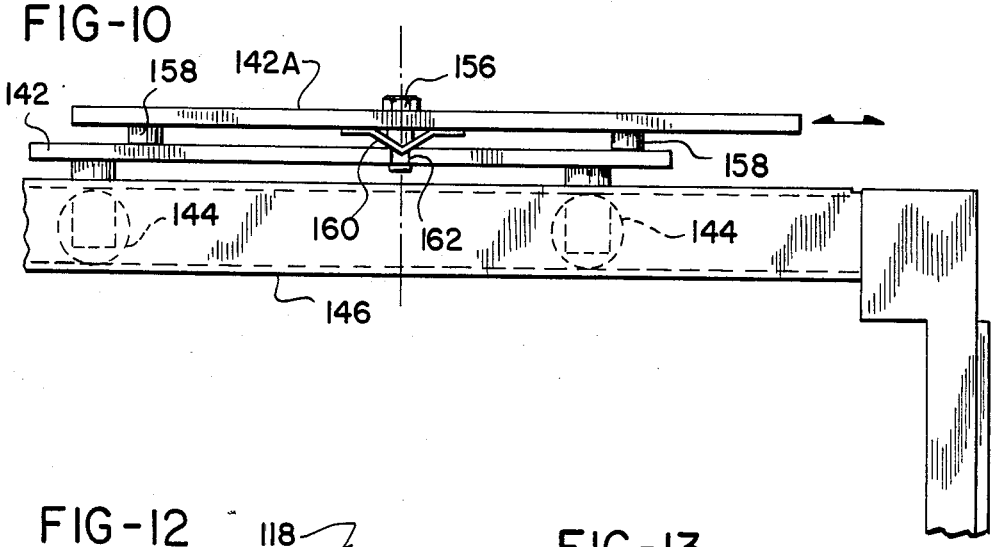
Figure 11:
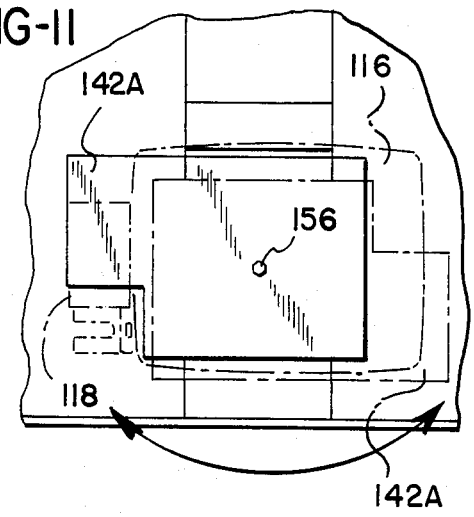
FIG. 11 shows the pivotal movement of the mounting plate of FIGS. 8–10 (see drawing sheet 8).

In FIG. 11, the automatic labeling position is shown by the solid line drawing of the movable plate 142A and the manual labeling position by the dot-dash line drawing of the movable plate 142A. The movable plate 142A may be biased into either of the two positions shown in FIG. 11 by means of spring clips 160 shown in FIG. 10 secured to the bottom of the movable plate 142A for engaging detents 162 formed in the upper surface of the support plate 142 when the movable plate 142A is moved to either the automatic labeling position or the manual labeling position as described.

It is noted that the price labeler 116 and the hi-lite labeler 120 must be sufficiently separated from one another for the movable plate 142A to be pivoted between the automatic labeling position over the wrapping and labeling station and the manual labeling position substantially over the package input station. Alternately, the hi-lite labeler 120 may be removed from its support plate 148 for movement of the price labeler 116 and associated label applicator 118 between the automatic labeling position and the manual labeling position.

Figure 12:
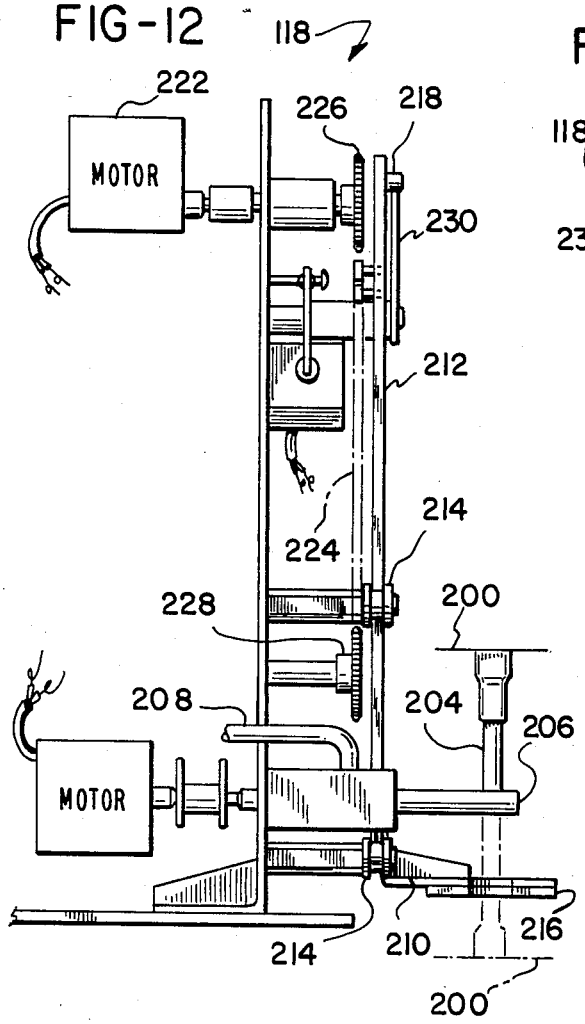
FIGS. 12–14 show an illustrative embodiment of a price label applicator for use in the present invention.
Figure 13:
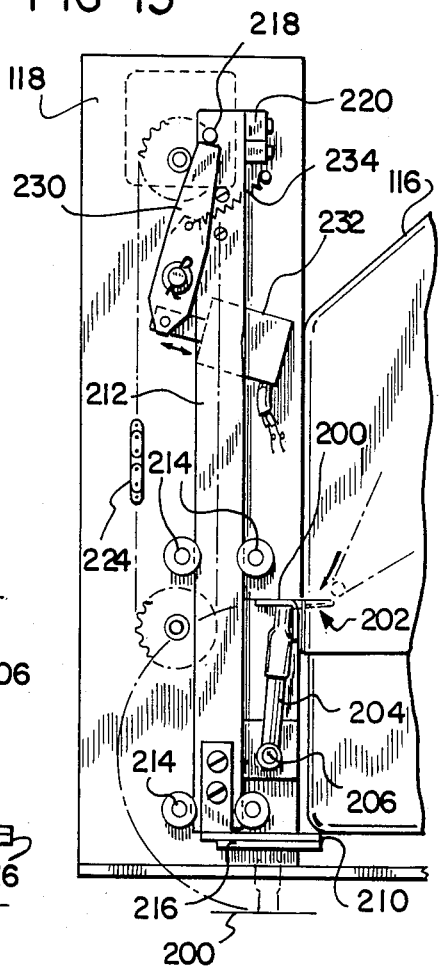
Figure 14:
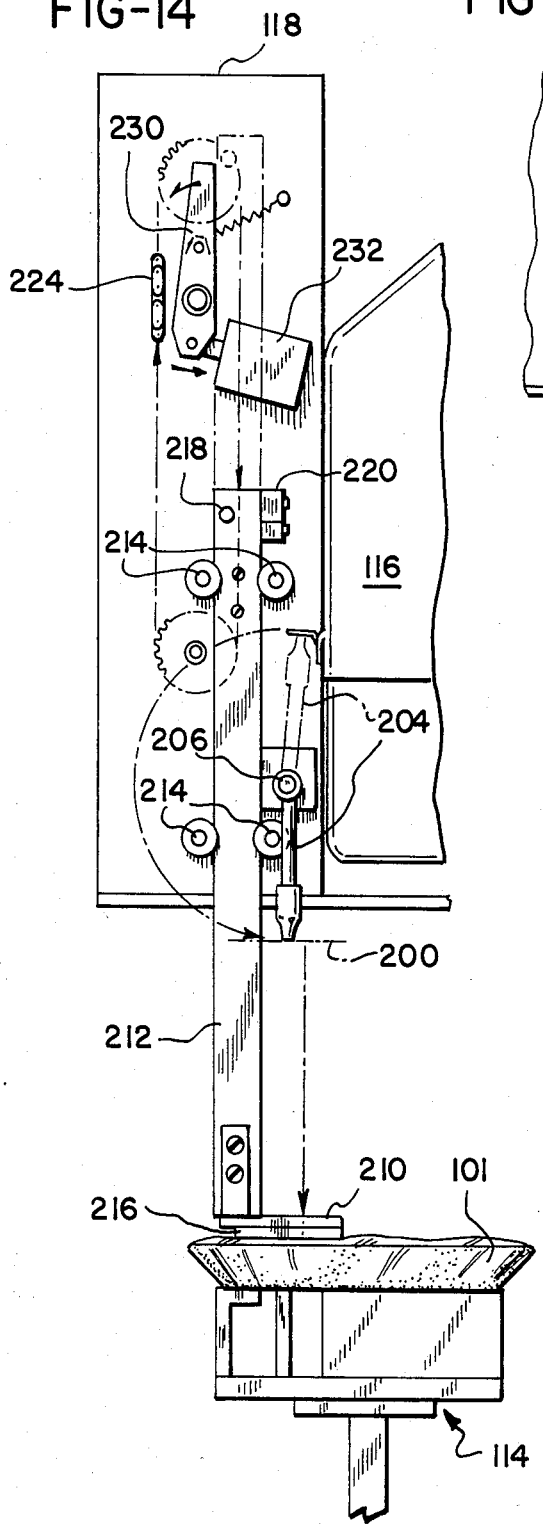

Label application is substantially in accordance with Treiber, U.S. Pat. No. 4,561,921 which is assigned to the same assignee as the present application and is incorporated herein by reference. Due the space constraints of the invention of the present application, the label applicator design of referenced U.S. Pat. No. 4,561,921 is not directly applicable and, hence, an illustrated embodiment of the label applicator 118 is shown in FIGS. 12–14.

Printing of a price label 200 and delivery of the label 200 to a label delivery station 202 is in accordance with referenced U.S. Pat. No. 4,561,921 The label 200 is discharged from the price labeler 116 with its adhesive coated side facing upward and its printed side facing downward. A label transfer nozzle 204 is pivotable about a horizontal axis 206 between a first position in which it engages the printed side of the label 200 by means of vacuum supplied through a vacuum line 208 and a second position illustrated in FIG. 14 in which the adhesive coated side of the label 200 is facing generally downward. The vacuum is connected through the transfer nozzle 204 to an elongated vacuum port (not shown) in the distal end of the transfer nozzle 204.

An applicator head 210 removes the label 200 from the transfer nozzle 204 when the transfer nozzle 204 is in its second position. The applicator head 210 is connected to a gravity label applier member 212 which is supported for free vertical movement by rollers 214. The applicator head 210 may include a resilient facing pad 216 to cushion the application of the label 200 to the package 101. The gravity label applier member 212 includes a control pin 218 and a stop member 220 both extending from the upper end of the gravity label applier member 212. The stop member 220 limits the downward movement of the gravity label applier member 212 if a package is not positioned beneath the applicator head 210.

Prior to label application, the gravity label applier member 212 is raised to its uppermost position by a motor 222. The motor 222 drives a chain 224 which is trained around a sprocket 226 driven by the motor 222 and an idler sprocket 228. The chain 224 is connected to the gravity label applier member 212 such that when the motor 222 is operated, the gravity label applier member 212 is raised to its uppermost position where the control pin 218 is engaged by a lever arm 230 and thereby locked into its uppermost position.

When the package 101 has been raised by the elevator 114 into a stretched sheet of film wrapping material which is then wrapped about the package 101 and the label 200 has been moved to the second position as shown in FIG. 14, a solenoid 232 is activated to move the lever arm 230 such that it disengages the control pin 218 and, since the motor 222 is not activated, the gravity label applier 212 and the label applicator head 210 are free to fall and thereby engage the label 200 and firmly apply it to the upper surface of the film being wrapped about the package 101.

After label application, the motor 222 is once again activated to raise the gravity label applier member 212 to its uppermost position. The solenoid 232 is released and a tension spring 234 returns the lever arm 230 to a position such that the control pin 218 is again engaged by the lever arm 230 and the gravity label applier member 212 is once again latched in its uppermost position as shown in FIG. 13. This sequence is repeated for each of the packages processed by the packaging machine 100 or carried on a package conveyor.

Figure 16:
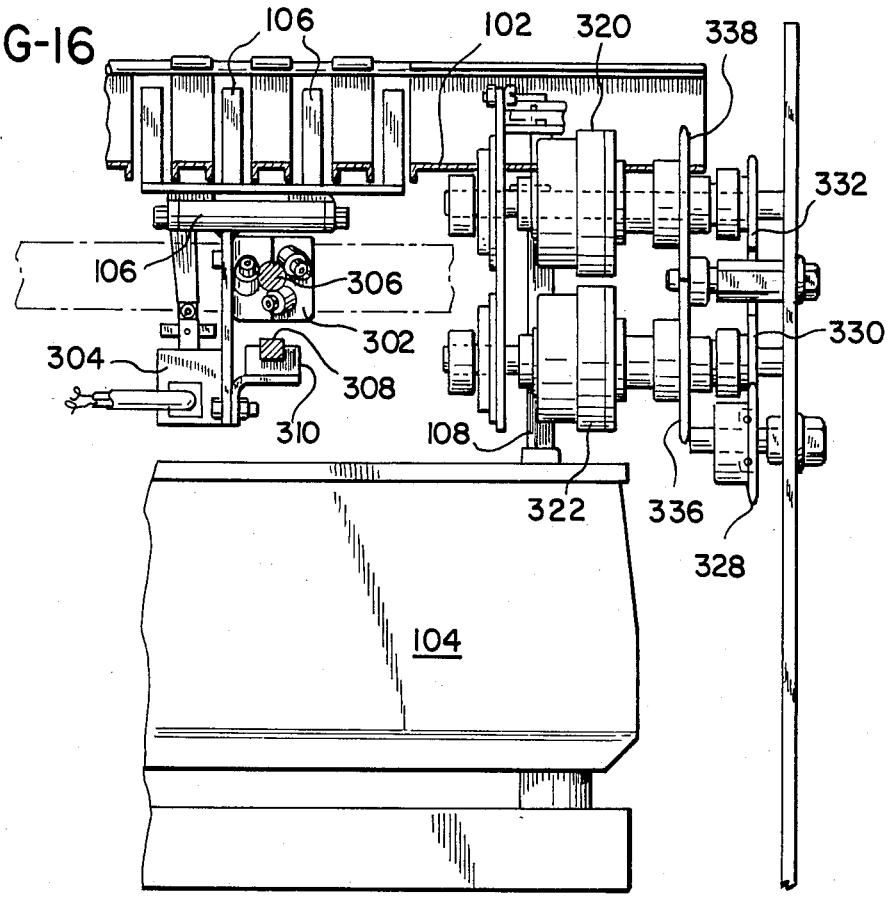

An illustrated embodiment of the package pusher 106 will now be described with reference to FIGS. 15 and 16. As previously noted, the input tray 102 forms the weighing platter for the scale 104. To permit the package pusher 106 to be located beneath the input tray 102 and yet extend thereabove for engaging packages and pushing them further into the packaging machine 100, the input tray 102 is slotted as previously described and shown in FIGS. 1, 4 and 16.

The package pusher 106 comprises a generally L-shaped member with the long leg 106A of the L being pivotally mounted by a pin 300 to a bracket supported from a linear actuator 302. The positioning of the package pusher 106 is controlled by means of an electrical solenoid 304 also supported from the linear actuator 302. Under the control of the solenoid 304, the package pusher 106 is selectively pivoted or operated between a package engaging position for pushing packages into the packaging machine 100 and a package non-engaging position for retracting the package pusher 106 beneath the package input station defined by the input tray 102. The raised position of the package pusher 106 is shown in FIG. 16, in the solid line drawing at the right side of FIG. 15 and in the phantom line drawing at the left side of FIG. 15. The non-engaging position is shown for the pusher 106 in a phantom line drawing in FIG. 15 at an intermediate position as the pusher 106 is being retracted beneath the package input station defined by the package input tray 102.

The linear actuator 302 is driven along a cylindrical rod 306 by rotation of the rod 306 as will be described. The use of such actuators for linear motion along a cylindrical rod is well known in the art with a suitable linear actuator being commercially available from Zero-Max and identified by their trademark Roh'lix. The package pusher 106 is stabilized by means of a square supporting post 308 and a stabilizing shoe 310 formed to slidingly engage the post 308 and secured to the linear actuator 302 as best shown in FIG. 16.

The cylindrical rod 306 which is rotated to control linear movement of the linear actuator 302 back and forth along the rod 306 is controlled by means of two electrical clutches 320 and 322. A chain 324 is driven by a sprocket 326. The chain 324 passes around an idler sprocket 328 and then passes counterclockwise around an input drive sprocket 330 of the electrical clutch 322 with the chain 324 then being passed clockwise around an input drive sprocket 332 of the electrical clutch 320. A drive chain 334 passes over a driven sprocket 336 of the electrical clutch 322 and a driven sprocket 338 of the electrical clutch 320 and a sprocket 340. The sprocket 340 is connected to a package pusher drive shaft 342 which in turn drives intermating bevel gears 344 for rotating the cylindrical rod 306.

If the electrical clutch 322 is activated, counter-clockwise rotation of the drive sprocket 330 is transferred to the driven sprocket 336 such that the chain 334 is rotated in the counter-clockwise direction to in turn drive the cylindrical rod 306 in the direction to advance the linear actuator 302 from the left to the right as shown in FIG. 15 and, hence, push the package 101 into the packaging machine 100. Alternately, if the clutch 320 is activated, the drive sprocket 332 rotating in the clockwise direction imparts clockwise motion to the driven sprocket 338 such that the chain 334 is rotated in the clockwise direction to impart rotation to the cylindrical rod 306 such that the linear actuator 302 is moved from the right to the left to retract the package pusher 106 to the initialized package pushing position to the far left of the input tray 102.

Accordingly, operation of the package pusher 106 is as follows. The package 101 is initially placed onto the input tray 102 where it is weighed by the scale 104.

Upon the determination of stable weight signals which are passed to the package labeler 116, the clutch 322 is activated such that the package pusher 106 advances the package 101 into the packaging machine 100. Upon reaching the full extent of its travel, the clutch 322 is deactivated and the solenoid 304 is activated to retract the package pusher 106 beneath the upper surface of the input tray 102 as shown in FIG. 15. The electrical clutch 320 is then activated to retract the package pusher 106 beneath the input tray 102 or package input station to the initialized left-most position as shown in phantom in FIG. 15. At this point, the clutch 320 is deactivated and the solenoid 304 is operated to raise the package pusher 106 into its package pushing position above the upper surface of the input tray 102. These operations are repeated for each package placed into the packaging machine 100.

Figure 17:
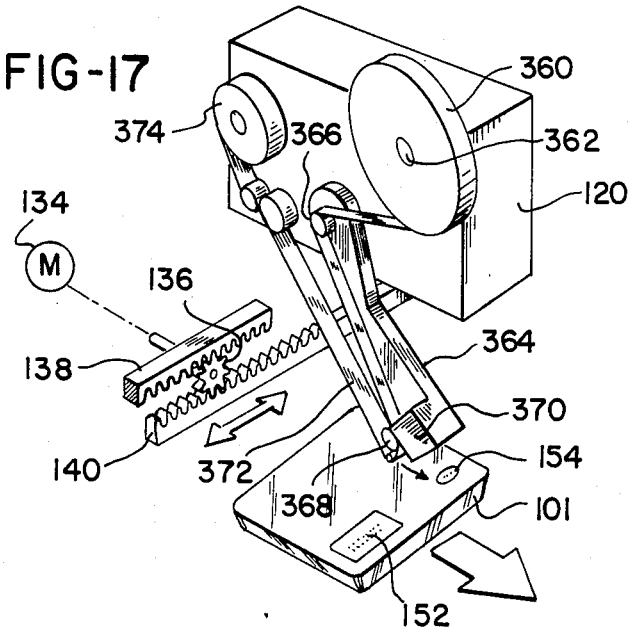
FIG. 17 shows an illustrative embodiment of a hi-lite labeler for use in the present invention.

An illustrative embodiment of the hi-lite labeler 120 is shown in FIG. 17. A roll of hi-lite label stock 360 is shown mounted to a spindle 362. A label applicator arm 364 is pivotally mounted about a capstan 366 which passes the label stock to a label feeding roller 368. The label applicator arm 364 includes a label head 370 which serves to apply a hi-lite label 154 to the package 101 as the label 154 is stripped from backing material 372 in accordance with well known labeling techniques. The backing material 372 is ultimately accumulated on a take-up spool 374. Preferably, the labeling head 370 includes thermal or other label printing apparatus such that the hi-lite labeler 120 can provide for printing hi-lite information which is to appear on the hi-lite labels 154. Of course, pre-printed labels can be applied in accordance with the present invention. In the event hi-lite information is provided and printed onto the individual hi-lite labels 154, the appropriate hi-lite information may be inputed by an operator of the packaging machine 100 via the keyboard 117.

The above description of an illustrative embodiment of the present invention clearly provides label positioning within an integrated packaging system, such as the system disclosed in the referenced Boshinski patent. As will be apparent to those skilled in the art, the invention of the present application is broadly applicable to label positioning by horizontal shifting of a package labeler in response to package dimensions which are indicative of the side edges of the packages. Accordingly, the invention is generally applicable to any packaging or package conveying system wherein it is desired to position labels within designated label regions of packages processed or conveyed by the systems.

While the methods herein described and the forms of apparatus for carrying these methods into effect constitute preferred embodiments of this invention, it is to be understood that the invention is not limited to these precise methods and forms of apparatus and that changes may be made in either without departing from the scope of the invention which is defined in the appended claims.

What is claimed is:

1. In a package handling system including a package conveyor for transporting packages along said conveyor, package labeling apparatus comprising:

package labeler means for labeling packages supported on said conveyor, said package labeler means being mounted for horizontal movement above said conveyor;

package sensing means for sensing at least one horizontal dimension of said packages as said packages are transported and for generating package signals representative of said at least one dimension; and label positioning means connected to said package labeler means and said package sensing means for horizontally moving said package labeler means in response to said package signals whereby package labels are positioned on said packages within selected labeling regions for convenient handling, display and sale.

2. Package labeling apparatus as claimed in claim 1 wherein said package labeler means further comprises label printer means for generating labels for said packages.

3. Package labeling apparatus as claimed in claim 2 further comprising weighing means positioned along said conveyor for determining the weight of packages on said conveyor and for generating weight signals representative thereof, and wherein said label printer means is responsive to said weight signals for printing price information for said packages on said labels.

4. Package labeling apparatus as claimed in claim 2 wherein said label printer means prints hi-lite labels containing information relating to the contents of said packages.

5. A method for labeling packages comprising the following steps:

conveying a package to be labeled to a labeling station;

supporting a package labeler for horizontal movement to define said labeling station;

generating package signals identifying at least two opposite sides of said package;

horizontally moving said package labeler in response to said package signals to select a labeling position corresponding to said package signals; and applying a label to the selected labeling position of said package at said labeling station.

6. A method for labeling packages as claimed in claim 5 wherein the step of generating package signals comprises sensing said package as it is being conveyed to said labeling station.

7. A method for labeling packages as claimed in claim 6 further comprising the step of generating said label for said package labeler.

8. A method for labeling packages as claimed in claim 7 further comprising the step of determining the weight of said package and wherein the step of generating said label comprises printing the price determined from the weight of said package on said label.

9. A method for labeling packages as claimed in claim 7 wherein the step of generating said label comprises printing a hi-lite label.

10. In a packaging machine wherein packages to be weighed, wrapped and labeled are conveyed from a package input station to a package wrapping and labeling station where an elevator raises packages into sections of wrapping material which are then wrapped about said packages as labels are applied thereto, a package labeling arrangement comprising:

transportation means for conveying packages from said package input station to said package wrapping and labeling station;

weighing means positioned along said transportation means for generating weight signals in response to said packages;

control means for generating package signals representative of at least one horizontal dimension of said packages;

label printing means connected to said weighing means and responsive to said weight signals for printing labels for said packages and delivering said labels to a label delivery station;

label applicator means positioned over said elevator for receiving labels from the label delivery station of said label printing means and applying said labels to said packages as said packages are being wrapped; and label positioning means connected to said label applicator means and said control means for shifting the position of said label applicator means horizontally in response to said package signals whereby package labels are positioned on said packages within selected labeling regions for convenient handling, display and sale.

11. A packaging machine as claimed in claim 10 wherein said label printing means is pivotally mounted such that it can be pivoted between an automatic labeling position over said wrapping and labeling station and a manual labeling position substantially over said package input station.

12. A packaging machine as claimed in claim 10 wherein said control means comprises sensing means for determining said at least one horizontal dimension of said packages as said packages are conveyed from said package input station to said package wrapping and labeling station.

13. A packaging machine as claimed in claim 10 wherein said control means comprises data storage means programmed for generating said at least one horizontal dimension of said packages.

14. In a packaging machine wherein a package to be weighed, wrapped and labeled is conveyed from a package input station to a package wrapping and labeling station where an elevator raises the package into a section of wrapping material which is then wrapped about said package as a label is applied thereto, a method for package labeling comprising the following steps:

weighing said package to generate weight signals representative of said package;

conveying said package to said package wrapping and labeling station;

generating package signals representative of at least one horizontal dimension of said package;

printing a label in response to said weight signals;

horizontally moving label applying means positioned vertically over said package wrapping and labeling station in response to said package signals to select a labeling position corresponding to said package signals; and applying said label to said package as said package is being wrapped in said section of wrapping material.

15. A method of package labeling as claimed in claim 14 wherein the step of generating package signals comprises sensing said at least one horizontal dimension of said package as it is conveyed to said package wrapping and labeling station.

16. A method of package labeling as claimed in claim 14 wherein the step of generating package signals comprises reading said package signals from data storage means wherein they have been previously stored.

17. A method of package labeling as claimed in claim 14 further comprising pivotally mounting a label printer which performs the step of printing a label whereby said label printer can be pivoted between an automatic labeling position wherein labels are fed over said package wrapping and labeling station and a manual labeling position wherein labels are fed substantially over said package input station.

18. A packaging machine for weighing, wrapping and labeling packages containing known commodities, said packaging machine comprising:

a package input station for receiving packages into said packaging machine;

a combined package wrapping and labeling station including a vertically reciprocating elevator for raising packages positioned thereon into sections of wrapping material to be wrapped about said packages;

package transporting means for conveying packages from said package input station to the elevator of said combined package wrapping and labeling station;

weighing means positioned along said package transporting means for sensing the weight of packages placed onto said package input station;

a label printer located at said combined package wrapping and labeling station for printing package information, including package price, onto labels to be applied to said packages;

a label applicator positioned over said elevator at said package wrapping and labeling station for receiving labels printed by said label printer and applying them to the upper surface of said wrapping material as said packages are being wrapped;

processor means for computing the price to be printed on said labels, said processor means including storage means and an input section for receiving unit pricing information regarding the commodities within said packages and being connected to said weighing means and said label printer;

control means for generating package signals representative of at least one horizontal dimension of said packages; and label positioning means connected to said label applicator and said control means for shifting the position of said label applicator horizontally in response to said package signals.

19. A packaging machine for weighing, wrapping and labeling packages containing known commodities, said packaging machine comprising:

a package input station including a weighing scale for sensing the weight of packages placed into said package input station;

a combined package wrapping and labeling station including a vertically reciprocating elevator for raising packages positioned thereon into sections of wrapping material to be wrapped about said packages, said elevator being on substantially the same level as said input station when in its lowered position;

package transporting means for conveying packages from said input station to said elevator, said package transporting means comprising a conveyor extending from said input station through said wrapping and labeling station, and a package pusher associated with said input station, said package pusher being operable between a package engaging position to push a package from said input station onto said conveyor and a package non-engaging position to permit said package pusher to be returned beneath said input station;

pusher control means for operating said package pusher between said package engaging position and said package non-engaging position;

a label printer located at said wrapping and labeling station for printing package information, including price information, onto labels to be applied to said packages;

a label applicator positioned over said elevator at said wrapping and labeling station for receiving labels printed by said label printer and applying them to the upper surface of said wrapping material as packages are being wrapped;

processor means for computing the prices to be printed on said labels, said processor means including storage means and an input section for receiving unit pricing information regarding the commodities within said packages and being connected to said weighing scale and said label printer;

label control means for generating package signals representative of at least one horizontal dimension of said packages; and label positioning means connected to said label applicator and said label control means for shifting the position of said label applicator horizontally in response to said package signals.

20. In a packaging machine wherein packages to be weighed, wrapped and labeled are conveyed from a package input station to a package wrapping and labeling station where an elevator raises said packages into sections of wrapping material which are then wrapped about said packages as labels are applied thereto, said packages being divided into at least two package size groups identified either by sensing said packages within said packaging machine or as identified by a machine operator, said package size groups being used by said packaging machine to select appropriately sized sections of wrapping material, a method for package labeling comprising the following steps:

weighing said packages to generate weight signals representative of said packages;

conveying said packages to said package wrapping and labeling station;

generating package size group signals representative of said packages;

printing labels in response to said weight signals;

horizontally moving label applying means positioned over said package wrapping and labeling station in response to said package size group signals to select a labeling position corresponding to said package size group signals; and applying said labels to said packages as said packages are being wrapped in said sections of wrapping material.

21. In a packaging machine wherein packages to be wrapped and labeled are conveyed from a package input station to a package wrapping and labeling station where the packages are elevated into sections of wrapping material which are then wrapped about said packages as labels are applied thereto, a package labeling arrangement comprising:

transportation means for conveying packages from said package input station to said package wrapping and labeling station;

control means for generating package signals representative of at least one horizontal dimension of said packages;

hi-lite label feeder means for delivering hi-lite labels to a hi-lite label delivery station;

hi-lite label applicator means positioned over said wrapping and labeling station for receiving hi-lite labels from the hi-lite label delivery station of said hi-lite label feeder means and applying said hi-lite labels to said packages as said packages are being wrapped; and hi-lite label positioning means connected to said hi-lite label applicator means and said control means for shifting the position of said hi-lite label applicator means horizontally in response to said package signals whereby hi-lite labels are positioned on said packages within a selected hi-lite labeling region for convenient handling, display and sale.

22. A packaging machine as claimed in claim 21 further comprising hi-lite label data storage means for storing hi-lite label information, and wherein said hi-lite label feeder means is connected to said hi-lite label data storage means and includes printing means for generating hi-lite labels in response to said hi-lite label information.

23. A packaging machine as claimed in claim 21 further comprising:

weighing means positioned along said transportation means for generating weight signals in response to said packages;

price label printing means connected to said weighing means and responsive to said weight signals for printing price labels for said packages and delivering said price labels to a price label delivery station; and price label applicator means positioned over said wrapping and labeling station for receiving price labels from the price label delivery station of said price label printing means and applying said price labels to said packages as said packages are being wrapped, said label positioning means being further connected to said price label applicator means for shifting the position of said price label applicator means horizontally in response to said package signals whereby price labels are also applied and positioned on said packages within selected price labeling regions for convenient handling, display and sale.

24. In a packaging machine wherein a package to be wrapped and labeled is conveyed from a package input station to a package wrapping and labeling station where the package is elevated into a section of wrapping material which is then wrapped about said package as a label is applied thereto, a method for package labeling comprising the following steps:

conveying said package to said package wrapping and labeling station;

generating package signals representative of at least one horizontal dimension of said package;

delivering a hi-lite label to hi-lite label applying means positioned over said package wrapping and labeling station;

horizontally moving said hi-lite label applying means in response to said package signals to select a hi-lite labeling position corresponding to said package signals; and applying said hi-lite label to said package as said package is being wrapped in said section of wrapping material.

25. A method of package labeling as claimed in claim 24 wherein the step of delivering a hi-lite label to hi-lite label applying means comprises printing said hi-lite label to reflect hi-lite label information corresponding to a package being processed by said packaging machine.

26. A method of package labeling as claimed in claim 24 further comprising the following steps:

weighing said package to generate weight signals representative of said package;

printing a price label in response to said weight signals;

delivering said price label to a price label applying means positioned over said package wrapping and labeling station;

horizontally moving said price label applying means in response to said package signals to select a price labeling position corresponding to said package signals; and applying said price label to said package as said package is being wrapped in said section of wrapping material.

* * * * *